US005933868A

United States Patent [19]

Bender

[11] Patent Number: 5,933,868

[45] Date of Patent: Aug. 10, 1999

[54] SPORTS GLOVE

[76] Inventor: Markus R. Bender, 270 N. Canon Dr., #1013, Beverly Hills, Calif. 90210

[21] Appl. No.: 09/016,591

[22] Filed: Jan. 30, 1998

[51] Int. Cl.[6] ..... A41D 13/08

[52] U.S. Cl. ..... 2/161.1; 2/16; 2/162

[58] Field of Search ..... 2/161.1, 162, 16, 2/170, 159, 161.4, 20; 602/21; 473/62

[56] References Cited

U.S. PATENT DOCUMENTS

| | | | |
|---|---|---|---|
| 3,049,717 | 8/1962 | Meyer | 2/161.1 |
| 3,229,306 | 1/1966 | Bazar | 2/161.1 |
| 3,707,730 | 1/1973 | Slider | 2/161.1 |
| 4,047,250 | 9/1977 | Norman | 2/161.1 |
| 5,313,667 | 5/1994 | Levine | 2/162 |
| 5,600,849 | 2/1997 | Hu | 2/16 |
| 5,638,548 | 6/1997 | Kawakami | 2/161.1 |
| 5,708,981 | 1/1998 | Tilton | 2/161.1 |
| 5,778,449 | 7/1998 | Oetting et al. | 2/16 |

*Primary Examiner*—Amy Vanatta
*Attorney, Agent, or Firm*—Michael Zarrabian

[57] ABSTRACT

A wrist protection sports glove for the hand and wrist of a wearer, the glove comprising a glove body and an elongated wristband portion for securing the wristband about a wearer's wrist. The glove body includes a palm portion having a front portion and a rear portion, the front portion including one or more finger openings thereon; and a flexible support member projecting from a part of the palm portion, at least a portion of the support member having sufficient stiffness for placement, positioning and providing support against at least a portion of the back portion of the wearer's hand during use of the glove. The wristband portion is attached to the rear portion of the palm portion, and includes fastening means for adjustably securing the wristband about the wrist of the wearer.

20 Claims, 4 Drawing Sheets

10

SPORTS GLOVE

BACKGROUND

The present invention relates to sports gloves, and, in particular, to sports gloves providing wrist protection.

People wear gloves while engaging in various activities such as sports to protect their hands and more effectively control sporting equipment. Due to its physical structure, the wrist area of the hand is prone to injury from excessive bending or stretching. As such, conventional gloves attempt to provide wrist protection mechanisms to protect the wrist against such injuries. Existing sports glove typically include a glove body having a palm portion, a back of hand portion and finger sleeves enclosing a wearer's hand. Such gloves can also include a wristband to be secured about the wearer's wrist to support the wrist.

A disadvantage of existing gloves is that the wrist portion of such gloves does not provide adequate protection against excessive bending or stretching of the wrist. This is because the wrist portion of such gloves must be flexible enough to accommodate normal bending of the wrist. Further, such gloves do not provide any protection against excessive stretching of the wrist. In case of gloves with wristbands, for example, the wristband must remain lose enough around the wearer's wrist to allow blood circulation to the hand and to allow normal bending of the wrist. And, such gloves are frequently not adjustable for comfort or to fit different size hands.

There is, therefore, a need for a sports glove with wrist protection which substantially prevents excessive bending and stretching of the wrist of a wearer. There is also a need for such a glove to accommodate normal bending of the wrist and remain comfortable to wear. There is also a need for such a glove to be adjustable.

SUMMARY

The present invention satisfies these needs. In one embodiment, the present invention provides a wrist protection sports glove for the hand and wrist of a wearer, comprising a glove body and a wristband portion for securing the wristband about a wearer's wrist. The glove body includes: (1) a palm portion having a front portion and a rear portion, the front portion including one or more finger openings thereon, and (2) a flexible support member attached to a part of the palm portion, at least a portion of the support member having sufficient stiffness for placement, positioning and providing support against at least a portion of the back portion of the wearer's hand during use of the glove. The wristband portion is attached to the rear portion of the palm portion, and includes fastening means for adjustably securing the wristband about the wrist of the wearer.

The palm protion can further include side portions extending between said front and rear portions, and at least one flap projecting from one of said side portions, the flap including fastening means for adjustably securing the flap about a portion the back of the hand of the wearer, forming a back-of-hand portion of the glove body.

The wrist band can be shaped and sized to be placed about the wearer's wrist joint about the area of transverse carpal ligament, a portion of the radius and the ulna bone structure and a portion of the brachioradialis muscle at the muscle position over the radius at said bone structure at the wrist of the wearer. The support member can project from the front portion of the palm portion in a position extending from substantially the knuckles of the wearer's hand, over the transverse carpal ligament, and over the area of the brachioradialis muscle at the muscle position over the radius and the ulna bone structure at the wrist of the wearer. Further, the support member can extend beyond the wristband portion along the back of the hand of the wearer, wherein the support member can be secured over the back of the hand of the wearer by wrapping the wristband portion over the support member about the wearer's wrist during use of the glove.

The glove body can further include a plurality of finger sleeves for receiving fingers of the wearer. Each finger sleeve can have a proximal end connected to a finger opening in the palm portion, and a distal end extending away from the palm portion. The distal end can be open and configured to allow a finger to extend through the distal end when the glove is worn. The distal end can also be closed. One of the finger sleeves can be a thumb sleeve with an open or closed distal end.

DRAWINGS

These and other features, aspects and advantages of the present invention will become better understood with regard to the following description, appended claims and accompanying drawings where:

DESCRIPTION

Figure 1:
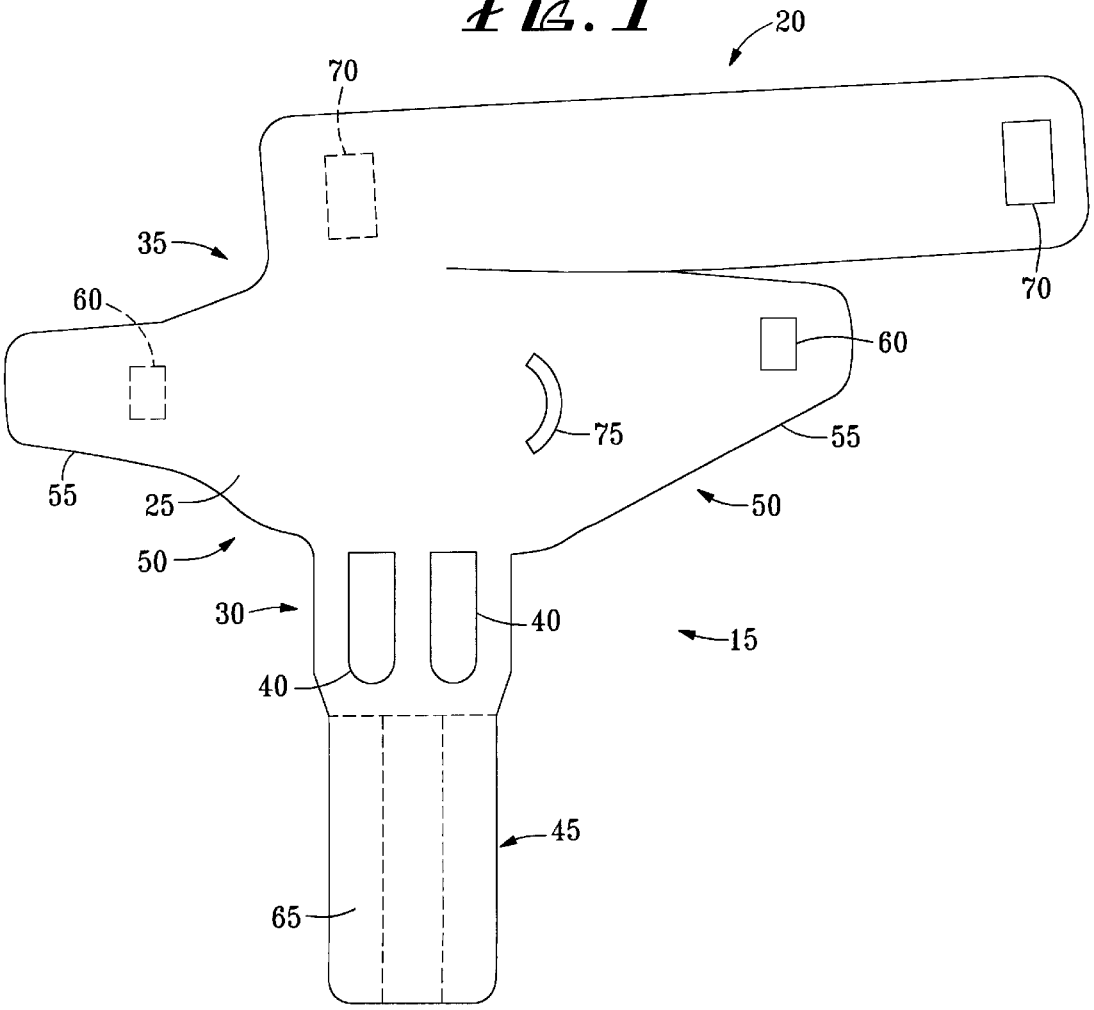
FIG. 1 shows a top view of an embodiment of a sports glove according to the present invention in an open position.

Referring to FIG. 1, an embodiment of a wrist protection sports glove 10 according to the present invention comprises a glove body 15 and a wristband portion 20 for securing the wristband portion 20 about a wearer's wrist. The glove body 15 includes: (1) a palm portion 25 having a front portion 30 and a rear portion 35, the front portion 30 including one or more finger openings 40 thereon, and (2) a flexible support member 45 attached to a part of the palm portion 25, at least a portion of the support member 45 having sufficient stiffness for placement, positioning and providing support against at least a portion of the back portion of the wearer's hand during use of the glove 10. The wristband portion 20 and the glove body 15 can be made from various flexible materials such as leather, vinyl, spandex, neoprene and the like. Further, the wristband portion 20 and the glove body 15 can include padding materials within, or thereon in contact with the hand of the wearer, to provide comfort and impact resistance.

In the embodiment of the invention shown in the drawings, the palm portion 25 is substantially rectangular in shape. However, other shapes and sizes for the palm portion 25 to cover different areas of the palm portion 25 of the hand of the wearer, such as substantially elliptical, and circular are also possible. The palm portion 25 can be from about 1 inch to about 5 inches long, and from about 1 inch to about 5 inches wide. Further, the palm portion 25 can be from about 0.125 inches to about 0.25 inches thick.

Figure 2:
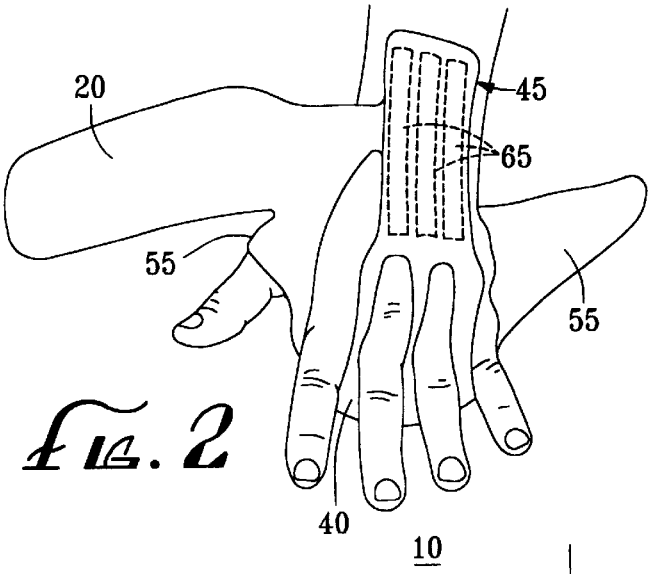
FIG. 2 shows a perspective view of the glove of FIG. 1 partially secured to a wearer's hand.

The palm portion 25 further includes side portions 50 extending between said front and rear portions 30, 35, and at least one flap 55 projecting from one of said side portions 50, the flap 55 including fastening means 60 for adjustably securing the flap 55 about a portion the back of the hand of the wearer, forming a back-of-hand portion of the glove body 15. As shown in FIG. 2, a flap 55 projects from each side portion 50 of the palm portion 25, and the flaps 55 are shaped and sized to overlap over the back of the hand of the wearer.

Figure 3:
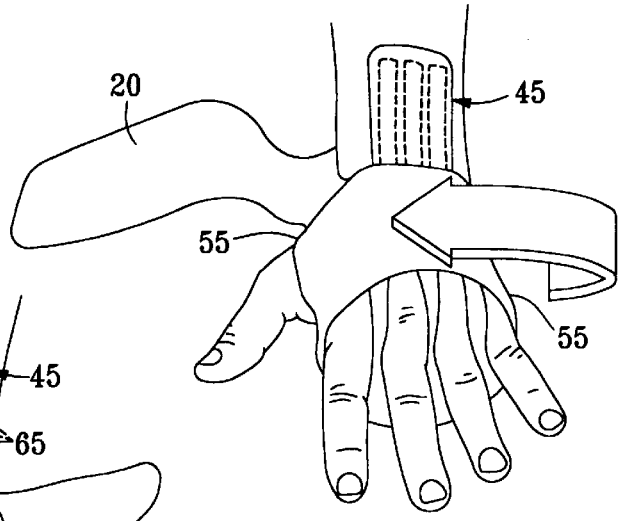
FIG. 3 shows a perspective view of the glove of FIG. 2 with flaps secured around the back of the wearer's hand over the support member.

The fastening means 60 of the flaps 55 can include hook and loop means attached to a free end of each flap 55 for adjustably securing the flaps 55 to one another about the back of hand of the wearer's hand as shown in FIG. 3. Each flap 55 is shaped and sized to be placed about a portion the wearer's back of hand as shown. Each flap 55 can be from about 2 inches to about 4 inches long, and from about 1 inch to about 2 inches wide. Each flap 55 can be from about 0.125 inches to about 0.25 inches thick. Each flap 55 can be tapered, as shown, substantially rectangular, elongated, or other sizes and shapes to cover different areas of the wearer's hand.

The support member 45 projects from the front portion 30 of the palm portion 25 in a position extending from substantially the knuckles of the wearer's hand, over the transverse carpal ligament, and over the area of the brachioradialis muscle at the muscle position over the radius and the ulna bone structure at the wrist of the wearer. Further, the support member 45 can extend beyond the wristband portion 20 along the back of the hand of the wearer, wherein the support member 45 can be secured over the back of the hand of the wearer by wrapping the wristband portion 20 over the support member 45 about the wearer's wrist during use of the glove 10 as shown in FIGS. 4 and 5.

Figure 4:
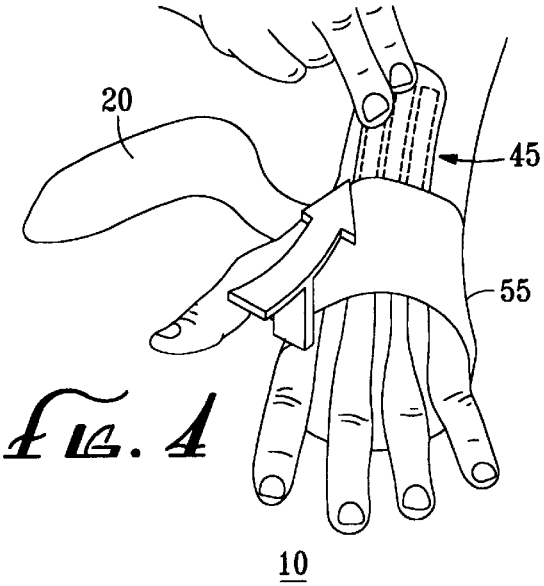
FIG. 4 shows a perspective view of the glove of FIG. 3 illustrating adjusment of the support memeber to an example position over the wrist of the wearer.
Figure 5:
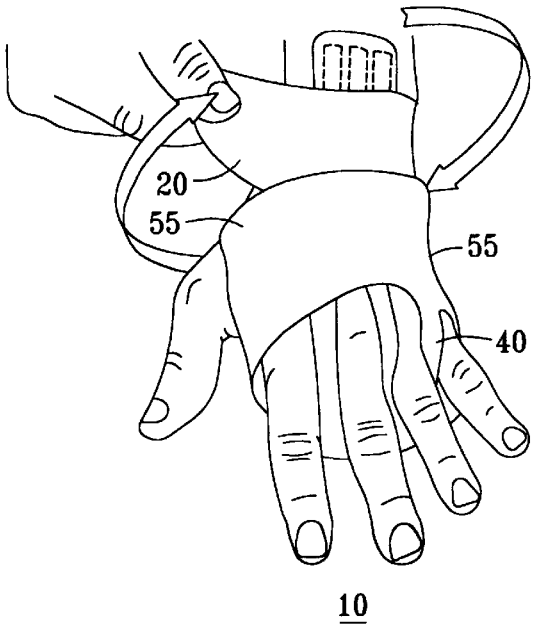
FIG. 5 shows a perspective view of the glove of FIG. 4 illustrating the wristband portion of the glove secured over the support member around the wearere's wrist.
Figure 6:
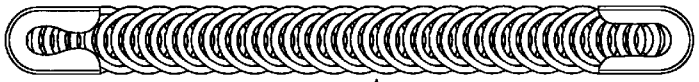
FIG. 6 shows a plan view of a cross section of strip material for the support member.

FIGS. 2–5 show placing and securing the support member 45 on the wearer's wrist. FIG. 2 shows the glove 10 partially secured to a wearer's hand. FIG. 3 shows flaps 55 secured around the back of the wearer's hand over the support member 45. FIG. 4 illustrates adjustment of the support member 45 to an example position over the wrist of the wearer. FIG. 5 illustrates the wristband portion 20 of the glove 10 secured over the support member 45 around the wearer's wrist. So secured, the support member 45 supports the wrist joint and ligaments of the hand and prevents injury by resisting excessive bending or excessive stretching of the wearer's wrist.

The support member 45 can be from about 3 inches to about 6 inches long, and from about 1 inches to about 2 inches wide. The support member 45 can be from about 0.125 inches to about 0.5 inches thick. The support member 45 can be substantially rectangular, as shown, tapered, or other shapes and sizes to cover different areas of the wearer's hand and wrist.

The support member 45 preferably includes at least one resilient strip 65 encased the material from which the glove body 15 is made from. The support member 45 has sufficient resiliency to bend and return to its original configuration, and with sufficient rigidity to allow the support member 45 to remain positioned against a portion of the back of the hand of the wearer's hand. The strip 65 can be made from metals, plastics, plexiglass, flat springs, and the like. In the embodiment shown in the drawings, the support member 45 includes three elongated strips 65 are encased in parallel along the length of the support member 45 in the material from which the glove body 15 is made. The shape, size and number of strips 65 can be selected based on the overall size of the glove 10, the length, width and thickness of the support member 45, and the desired resiliency of the support member 45 for various activities.

The wristband portion 20 is attached to the rear portion 35 of the palm portion 25, and includes fastening means 70 for adjustably securing the wristband portion 20 about the wrist of the wearer. The fastening means 70 can include hook and loop means attached to ends of the wristband portion 20 for adjustably securing the wristband portion 20 about the wrist of the wearer as shown in FIG. 5. In the embodiment of the glove 10 shown in the drawings, the wristband portion 20 is shaped and sized to be placed about the wearer's wrist joint about the area of transverse carpal ligament, a portion of the radius and the ulna bone structure and a portion of the brachioradialis muscle at the muscle position over the radius at said bone structure at the wrist of the wearer. The wristband portion 20 can be from about 9 inches to about 12 inches long, and from about 1.5 inches to 3 inches wide. The wristband portion 20 can be from about 0.125 inches to about 0.25 inches thick. The wristband portion 20 can be substantially rectangular as shown, or other shapes and size to cover different areas of the wearer's hand and wrist.

In the embodiment of the invention shown in the drawings, the finger openings 40 are substantially rectangular in shape. However, other shapes and sizes for the finger openings 40 for different size fingers and for comfort, such as substantially elliptical, and circular are also possible. The finger openings 40 can be can be from about 0.5 inches to about 4 inches long, and from about 0.5 inches to about 4 inches wide. The number of the finger openings 40 can be from one to five, including a thumb opening 75 on a side portion 50 of the palm portion 25.

The glove body 15 can further include a plurality of finger sleeves for receiving fingers of the wearer. Each finger sleeve can have a proximal end connected to a finger opening 40 in the palm portion 25, and a distal end extending away from the palm portion 25. The distal end can be open and configured to allow a finger to extend through the distal end when the glove 10 is worn. The distal end can also be closed. One of the finger sleeves can be a thumb sleeve with an open or closed distal end.

Figure 7:
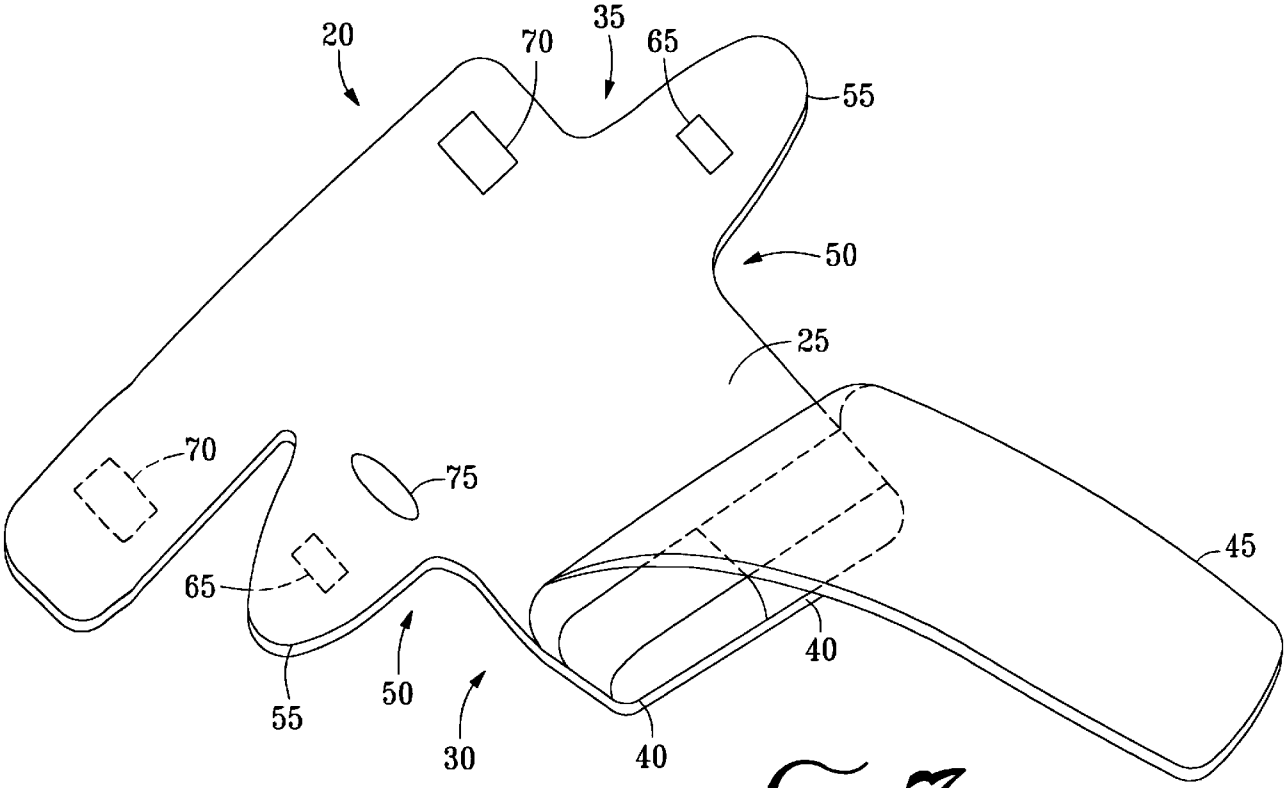
FIG. 7 shows a perspective view of another embodiment of the glove of the present invention wherein the support member is attached to both side portions of the palm portion.
Figure 8:
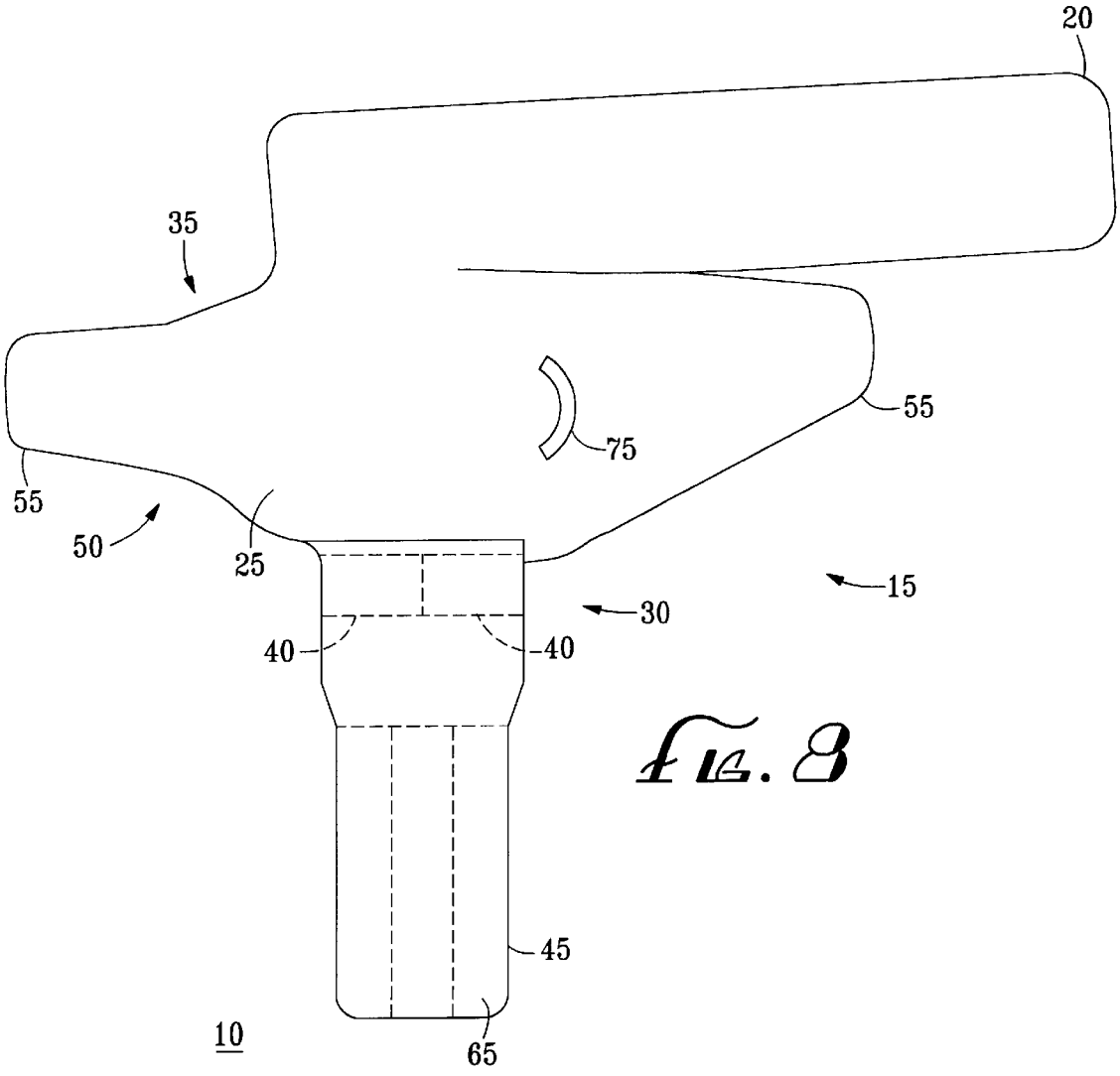
FIG. 8 is a top view of the glove of FIG. 7 in open position.

In the embodiment of the invention shown in FIGS. 1–5, the support member 45 projects from the front portion 30 of the palm portion 25 proximate the finger openings 40. However, as shown in FIGS. 7 and 8, in another embodiment of the present invention, the support member 45 can extend from, or be attached to, one or both side portions 50 of the palm portion 25, at least a portion of the support member 45 having sufficient stiffness for placement, positioning and providing support against at least a portion of the back portion of the wearer's hand during use of the glove 10.

Although the present invention has been described in considerable detail with regard to the preferred versions thereof, other versions are possible. Therefore, the appended claims should not be limited to the descriptions of the preferred versions contained herein.

What is claimed is:

1. A wrist protection sports glove for the hand and wrist of a wearer, the glove comprising:

(a) a glove body including:

(i) a palm portion having a front portion and a rear portion, the front portion including one or more finger openings thereon, and (ii) a flexible support member attached to a portion of the palm portion, at least a portion of the support member having sufficient stiffness for placement, positioning and providing support against at least a portion of the back portion of the wearer's hand during use of the glove, and (b) a wristband portion including fastening means for adjustably securing said wristband portion about the wrist of the wearer, the wristband portion being attached to the rear portion of the palm portion.

2. The glove of claim 1, wherein the palm portion further includes:

(a) side portions extending between said front and rear portions, and (b) at least one flap projecting from one of said side portions, the flap including fastening means for adjustably securing the flap about a portion the back of the hand of the wearer, forming a back-of-hand portion of the glove body.

3. The glove of claim 2, wherein the support member projects from a part of said front portion of the palm portion and extends beyond the flap along the back of the hand of the wearer, and wherein the support member can be secured over the back of the hand of the wearer by wrapping the flap over the support member about the a portion of the back of hand of the wearer during use of the glove.

4. The glove of claim 1, wherein the wrist band is shaped and sized to be placed about the wearer's wrist joint about the area of transverse carpal ligament, a portion of the radius and the ulna bone structure and a portion of the brachioradialis muscle at the muscle position over the radius at said bone structure at the wrist of the wearer.

5. The glove of claim 1, wherein the support member projects from a part of said front portion of the palm portion in a position extending from substantially the knuckles of the wearer's hand, over the transverse carpal ligament, and over the area of the brachioradialis muscle at the muscle position over the radius and the ulna bone structure at the wrist of the wearer.

6. The glove of claim 5, wherein the support member extends beyond the wristband portion along the back of the hand of the wearer, and wherein the support member can be secured over the back of the hand of the wearer by wrapping the wristband portion over the support member about the wearer's wrist during use of the glove.

7. The glove of claim 1, wherein the glove body further includes a plurality of finger sleeves for receiving fingers of the wearer, each finger sleeve having a proximal end connected to a finger opening in the palm portion and an open distal end extending away from the palm portion and configured to allow a finger to extend through the distal end when the glove is worn.

8. The glove of claim 7, wherein the distal end of at least one finger sleeve is closed.

9. The glove of claim 7, wherein the finger sleeves include a thumb sleeve configured to receive a thumb of the wearer.

10. The glove of claim 9, wherein the thumb sleeve includes a distal end, the distal end of the thumb sleeve is closed.

11. The glove of claim 1, wherein the fastening means of the wristband portion comprises a hook and loop means for adjustable securing the wristband about the wrist of the wearer.

12. A wrist protection sports glove for the hand and wrist of a wearer, the glove comprising:

(a) a glove body including:

(i) a palm portion having a front portion, a rear portion, and side portions extending therebetween, the front portion including one or more finger openings thereon, the palm portion further including at least one flap projecting from one of said side portions, the flap including fastening means for adjustably securing the flap about a portion the back of the hand of the wearer, forming a back-of-hand portion of the glove body, and (ii) a flexible support member projecting from a part of the palm portion, at least a portion of the support member having sufficient stiffness for placement, positioning and providing support against at least a portion of the back portion of the wearer's hand during use of the glove, and (b) an elongated wristband portion including fastening means for adjustably securing said wristband portion about the wrist of the wearer, the wristband portion being attached to the rear portion of the palm portion, wherein the wrist band is shaped and sized to be placed about the wearer's wrist joint about the area of transverse carpal ligament, a portion of the radius and the ulna bone structure and a portion of the brachioradialis muscle at the muscle position over the radius at said bone structure at the wrist of the wearer.

13. The glove of claim 12, wherein the support member projects in a position extending from substantially the knuckles of the wearer's hand, over the transverse carpal ligament, and over the area of the brachioradialis muscle at the muscle position over the radius and the ulna bone structure at the wrist of the wearer.

14. The glove of claim 13, wherein the support member extends beyond the wristband portion along the back of the hand of the wearer, and wherein the support member can be secured over the back of the hand of the wearer by wrapping the wristband portion over the support member about the wearer's wrist during use of the glove.

15. The glove of claim 12, wherein the support member extends beyond the flap along the back of the hand of the wearer, and wherein the support member can be secured over the back of the hand of the wearer by wrapping the flap over the support member about the a portion of the back of hand of the wearer during use of the glove.

16. The glove of claim 12, wherein the glove body further includes a plurality of finger sleeves for receiving fingers of the wearer, each finger sleeve having a proximal end connected to a finger opening in the palm portion and a distal end extending away from the palm portion and configured to allow a finger to extend through the distal end when the glove is worn.

17. A wrist protection sports glove for the hand and wrist of a wearer, the glove comprising:

(a) a glove body including:

(i) a palm portion having a front portion, a rear portion, and side portions extending therebetween, the front portion including one or more finger openings thereon, the palm portion further including two flaps, each flap projecting from one of said side portions and being sized and shaped for placement along a portion of the back of hand of the wearer, each flap including fastening means thereon for adjustably securing the flap to the other flap about a portion the back of the hand of the wearer, thereby forming a back-of-hand portion of the glove body, and (ii) a flexible support member projecting from a part of said front portion, at least a portion of the support member having sufficient stiffness for placement, positioning and providing support against at least a portion of the back portion of the wearer's hand during use of the glove, wherein the support member projects in a position extending from substantially the knuckles of the wearer's hand, over the transverse carpal ligament, and over the area of the brachioradialis muscle at the muscle position over the radius and the ulna bone structure at the wrist of the wearer, and (b) an elongated wristband portion including fastening means for adjustably securing said wristband portion about the wrist of the wearer, the wristband portion being attached to the rear portion of the palm portion, wherein the wrist band is shaped and sized to be placed about the wearer's wrist joint about the area of transverse carpal ligament, a portion of the radius and the ulna bone structure and a portion of the brachioradialis muscle at the muscle position over the radius at said bone structure at the wrist of the wearer.

18. The glove of claim 17, wherein the support member extends beyond the wristband portion along the back of the hand of the wearer, and wherein the support member can be secured over the back of the hand of the wearer by wrapping the wristband portion over the support member about the wearer's wrist during use of the glove.

19. The glove of claim 18, wherein the support member is sized and shaped such that the support member can be secured over the back of the hand of the wearer by wrapping the flaps over the support member about the a portion of the back of hand of the wearer during use of the glove.

20. The glove of claim 17, wherein the glove body further includes a plurality of finger sleeves for receiving fingers of the wearer, each finger sleeve having a proximal end connected to a finger opening in the palm portion and a distal end extending away from the palm portion and configured to allow a finger to extend through the distal end when the glove is worn.

* * * * *